US006116655A

United States Patent [19]

Thouin et al.

[11] Patent Number: 6,116,655

[45] Date of Patent: Sep. 12, 2000

[54] FRANGIBLE CARD WITH A SEALED COMPARTMENT

[76] Inventors: Mark E. Thouin; Kevin R. Cleghorn, both of P.O. Box 136, Swanton, Ohio 43558

[21] Appl. No.: 09/218,170

[22] Filed: Dec. 22, 1998

[51] Int. Cl.[7] ..... B42D 15/00

[52] U.S. Cl. ..... 283/107; 229/315; 229/316; 283/65; 283/904

[58] Field of Search ..... 283/65, 76, 117, 283/904, 107; 229/313, 314, 315, 316

[56] References Cited

U.S. PATENT DOCUMENTS

| | | | |
|---|---|---|---|
| 750,350 | 1/1904 | Denson | 229/314 |
| 1,180,542 | 4/1916 | Roden | 229/314 |
| 1,200,735 | 10/1916 | Klein | 229/314 |
| 1,411,077 | 3/1922 | Balogh | 229/314 |
| 2,408,626 | 10/1946 | Green . | |
| 2,431,561 | 11/1947 | Hyman . | |
| 4,174,857 | 11/1979 | Koza . | |
| 4,403,696 | 9/1983 | Newell | 206/623 |
| 4,967,951 | 11/1990 | Sherman | 229/70 |
| 5,028,076 | 7/1991 | Danelski . | |
| 5,380,046 | 1/1995 | Stephens . | |
| 5,743,568 | 4/1998 | Smith, III | 283/65 |
| 5,785,355 | 7/1998 | Main . | |

FOREIGN PATENT DOCUMENTS

| | | |
|---|---|---|
| 2232924 | 1/1991 | United Kingdom . |

*Primary Examiner*—Andrea L. Pitts
*Assistant Examiner*—Monica Smith Carter
*Attorney, Agent, or Firm*—Richard C. Litman

[57] ABSTRACT

The frangible card with a sealed compartment has a top sheet and a bottom sheet made from a synthetic, polymeric, plastic material, both sheets being substantially rigid and being sized and shaped substantially in the form of a conventional credit card, and thus being adapted for transport on or about the person in a wallet or billfold. An information storage medium, such as paper, film, or magnetic storage media, is interleaved between the top and bottom sheets. The top and bottom sheets are sealed around their periphery, preferably by ultrasonic welding, defining a sealed compartment. The top and bottom sheets are opaque in order to preserve the information stored in the sealed compartment in privacy. The top and bottom sheets are scored along one edge, so that access to the compartment is gained by breaking the card along the scored edge. Paper money or other flat valuables may be stored in the compartment with the information storage medium.

15 Claims, 3 Drawing Sheets

FRANGIBLE CARD WITH A SEALED COMPARTMENT

BACKGROUND OF THE INVENTION

1. Field of the Invention

The present invention relates to devices having compartments for storing paper money, documents, and other printed matter while retaining personal privacy, and particularly to a frangible card laminated at the edges with a sealed compartment.

2. Description of the Related Art

In modern society, people sometimes have a need for carrying documents or other valuables on their person, or for giving personal documents or valuables to a family member or loved one, while desiring to retain a degree of privacy or security towards the item. A common example relates to persons who have medical conditions requiring specialized treatment in the event of emergency. Such individuals may wish to have a card or other document which they may carry in a wallet, purse or other container which they would normally expect to have on or about their person, but who would prefer to carry the information about in a form in which the information is not open or in plain view. Such individuals may desire information concerning their medical condition to remain private in the event the wallet or purse is lost or mislaid and subsequently inspected by a stranger, or in the event curious or snooping individuals should come into possession of the card.

Another situation which frequently arises concerns parents who send their children away to college. The parent may wish the child to have a card available for emergencies, which may have information such as the name address and telephone of persons to contact in the event of an emergency which incapacitates the child. At the same time, the parent may wish to make a conditional gift of cash to the child for immediate use in an emergency, but retain sufficient control over the money to know whether it has been spent in order to request an accounting of the nature of the emergency. It would be desirable to have a portable, sealable container which may be carried on or about the person conveniently in which both the information card and money might be stored.

Several inventions relate to personal information cards, sealable document containers, and devices for preserving the privacy of documentary information. U.S. Pat. No. 2,408,626, issued Oct. 1, 1946 to L. B. Green, describes a device for dating documents and preserving their authenticity, in the form of an integral folder and cover which may be folded and sealed separately using gummed adhesive tabs along their edges, and a record sheet inserted in the cover portion. The original document and the record sheet are randomly perforated simultaneously to prevent alteration of the original, and the document may be mailed to obtain a postmark. U.S. Pat. No. 2,431,561, issued Nov. 25, 1947 to S. Hyman, shows a folding photo and match bookholder having a secret pocket under the matchbook held closed by a lug or by flaps.

U.S. Pat. No. 4,174,857, issued Nov. 20, 1979 to J. R. Koza, teaches a game or lottery ticket which preserves the privacy and security of the winning information, the ticket having a base sheet with numbers or prizes printed thereon covered by a material which may be rubbed off, and a cover sheet, the sheets being adhered by adhesive around their periphery and having "postage stamp perforations" disposed inside the adhesive along three of the four edges of the sheets. An optional bottom sheet may be used to ensure security of the numbers when they are printed by an impact printer which may leave indentations on the base sheet.

U.S. Pat. No. 5,028,076, issued Jul. 2, 1991 to J. J. Danelski, describes a product having a concealed message, consisting of a sheet of paper, paperboard, cardboard, or the like with ink printing covered by a transparent film layer. Some of the areas are bonded with a heat sealable coating so that the ink comes off with the transparent film, while other areas are bonded with a releasable coating so that the ink does not come off with the transparent film. A hidden message is revealed under the areas where the ink comes off when the transparent film is removed.

U.S. Pat. No. 5,380,046, issued Jan. 10, 1995 to G. W. Stephens, discloses a personal information packet having a foldable paper card inserted into a transparent, thermoplastic envelope with exposed printing advising the authorities how to open the envelope. The printing includes a dashed line around the periphery of the envelope which may be cut with scissors. The packet has a hole through it so that a child's shoelace may be inserted through the hole and the packet interlaced in the child's shoe. While the patent does not describe the device as being flexible, the manner of use permits that inference.

U.S. Pat. No. 5,785,355, issued Jul. 28, 1998 to G. W. Main, shows a single unit phone card including two sheets laminated together, the entire assembly then being laminated with plastic film. United Kingdom Patent No. 2,232,924, published Jan. 2, 1991, teaches a ticket with a voucher attached to the back of the ticket by parallel adhesive strips. The voucher is attached to the adhesive strips by perforations, so the voucher may be torn away from the ticket, permitting advertising and promotional information to be printed on both sides of the voucher.

Containers for information cards which are only sealed on three of their four sides are not calculated to deter the casual, idle curiosity seeker from pulling out the information card if the container should come into his possession. Containers which are sealed, but flexible, offer no protection to the information storage medium from damage by folding, and if made from paper of plastic, pose a risk of damage by accidental tearing of the container, the storage medium, or both. Information cards which are laminated with a rigid, transparent plastic offer no privacy protection for the information. Oversized containers are inconvenient to carry on or about the person. There is a need for a compact, relatively rigid frangible card with a sealed compartment adapted for carrying on the person which affords the bearer some degree of protection from unwanted disclosure of the contents of the compartment.

None of the above inventions and patents, taken either singularly or in combination, is seen to describe the instant invention as claimed. Thus a frangible card with a sealed compartment solving the aforementioned problems is desired.

SUMMARY OF THE INVENTION

The frangible card with a sealed compartment has a top sheet and a bottom sheet made from a synthetic, polymeric, plastic material, both sheets being substantially rigid and being sized and shaped substantially in the form of a conventional credit card, being adapted for transport on or about the person in a wallet or billfold. An information storage medium, such as paper, film, or magnetic storage media, is interleaved between the top and bottom sheets. The top and bottom sheets are sealed around their periphery, preferably by ultrasonic welding, defining a sealed compartment. The top and bottom sheets are opaque in order to preserve the information stored in the sealed compartment in privacy. The top and bottom sheets are scored along one edge, so that access to the compartment is gained by breaking the card along the scored edge. Paper money or other flat valuables may be stored in the compartment with the information storage medium.

Accordingly, it is a principal object of the invention to provide a frangible card with a sealed compartment in which medical or other sensitive information may be carried on or about the person for use in emergencies, while preserving the information in some degree of privacy by sealing the information in an opaque plastic card which may be broken open to retrieve the information.

It is another object of the invention to provide a non-reusable frangible card with a sealed compartment in which paper money may be stored together with emergency information, the card having a plastic edge which must be broken in order to gain access to the contents of the compartment so that tampering with the card is immediately apparent.

It is a further object of the invention to provide a convenient, portable card which may be carried on or about the person having a sealed compartment for containing an information storage medium recording useful information concerning the bearer which may be readily accessed by police or emergency medical personnel in case of an emergency while deterring access to the information by the casual bystander by providing the compartment with a frangible edge.

Still another object of the invention is to a means for carrying information or valuables on the person in a frangible card with a sealed compartment according the information or valuables a degree of privacy which may be economically manufactured from synthetic, polymeric, plastic material.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
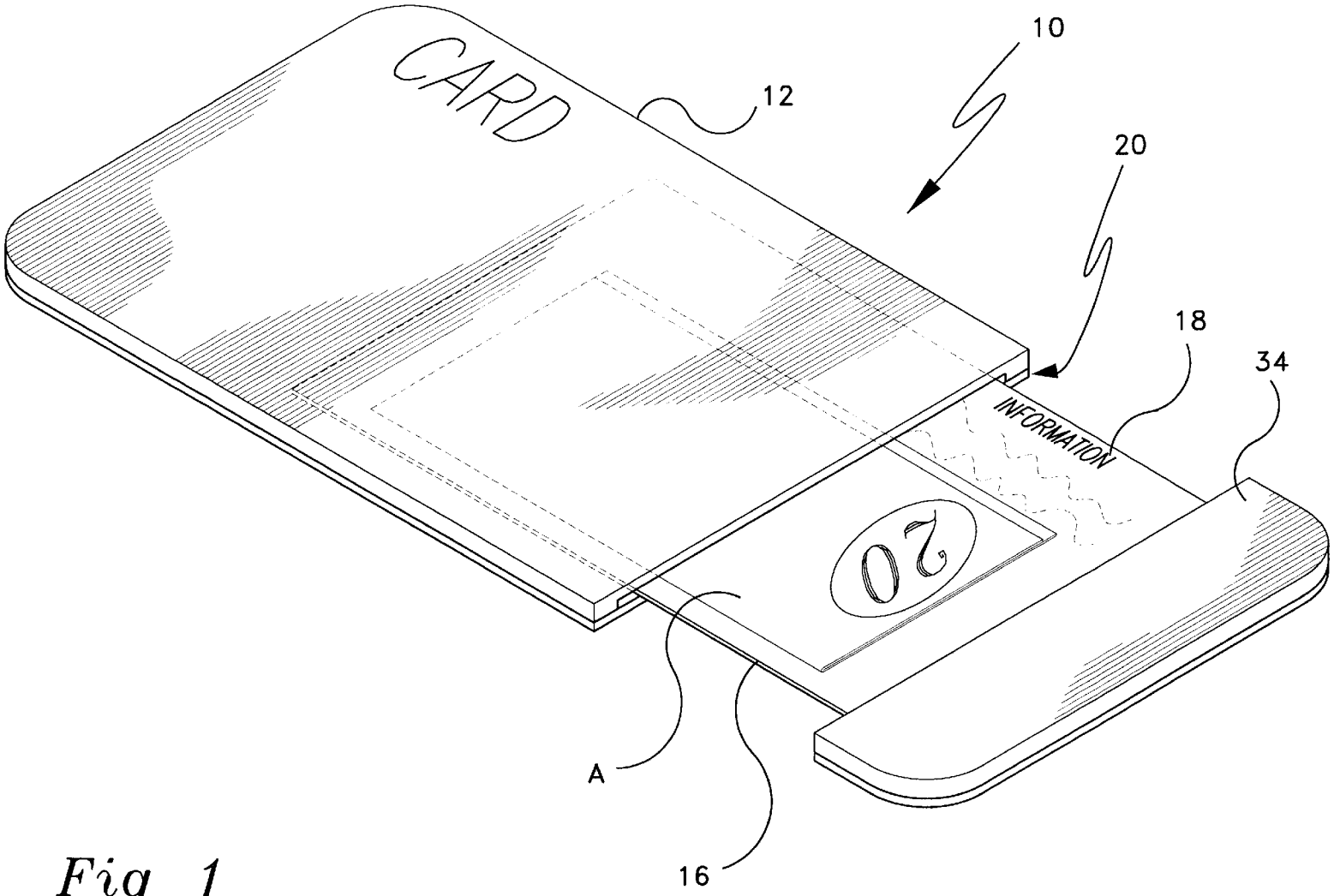
FIG. 1 is an environmental, perspective view of a frangible card with a sealed compartment according to the present invention.

The present invention is a frangible card with a sealed compartment, designated generally as 10 in FIGS. 1 through 4. The frangible card 10 includes a top sheet 12 and a bottom sheet 14, both of which are made from a synthetic, polymeric, plastic material. The sheets 12 and 14 are substantially rigid and generally rectangular in shape, being sized and shaped so that, when the sheets 12 and 14 are bonded together, the frangible card is sized and shaped substantially in the form of a conventional credit card. Thus, the frangible card 10 is adapted for transport on or about the person in a wallet, billfold, purse, or a shirt pocket.

An information storage medium 16 is interleaved between the top 12 and bottom 14 sheets. The information storage medium 16 may be paper, cardboard, or other flat material on which data 18 may be written or printed. An example of such information might include the bearer's name and address, the name, address and telephone number of next of kin or person to be contacted in case of emergency, medical conditions requiring special treatment in case of emergency, such as blood type and blood disorders, heart conditions, drug allergies, diabetes, etc. Of course, other types of information of a sensitive nature may also be recorded on the information storage medium 16. The information storage medium 16 might also be in a form which stores data in a condensed format, such as microfilm or magnetic tape, Such a medium 16 might be useful for condensed copies of EKG tracings, for example.

Figure 2:
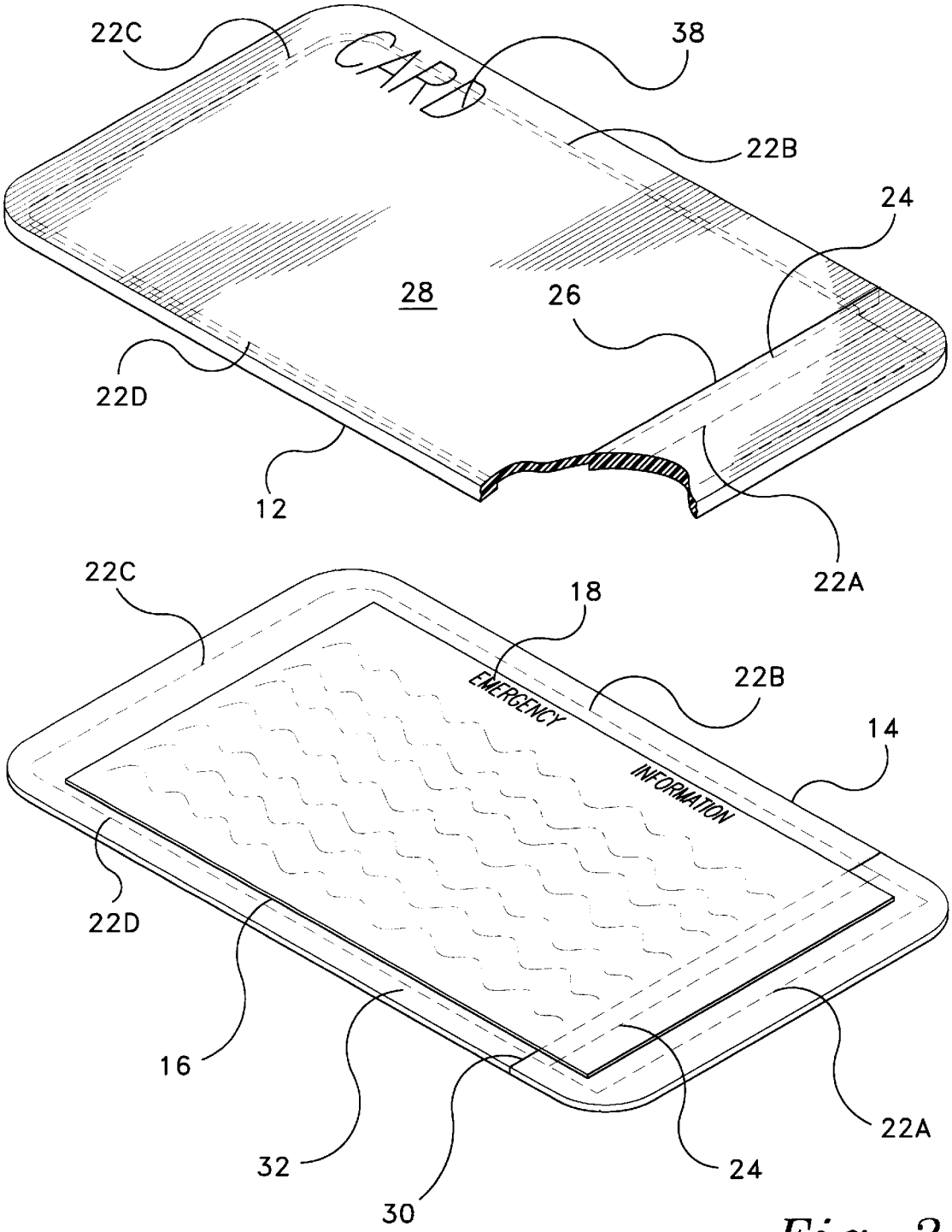
FIG. 2 is a partially exploded view of a frangible card with a sealed compartment according to the present invention.

The information storage medium 16 is placed between the top 12 and bottom 14 sheets, which are then joined together about their periphery so that the top 12 and bottom 14 sheets define a sealed compartment 20 in which the storage medium 16 is stored. The top 12 and bottom 14 sheets may be joined by any method conventionally known in the art, such as vibratory welding, ultrasonic welding, adhesive glues, nylon stitching, or staples. In the preferred embodiment, the sheets 12 and 14 are joined by ultrasonic welding. As shown in FIG. 2, the sheets 12 and 14 are joined around the periphery on all four sides, the position of the welding, adhesive, or other joining lines relative to the information storage medium 16 being shown by the lines 22*a*, 22*b*, 22*c*, and 22*d*. In the preferred embodiment, an additional joining line 24 is used to join the information storage medium 16 to the top and bottom sheets along one edge of the card 10 for a purpose described infra. As noted in FIG. 2, the joining lines 22*b*, 22*c*, and 22*d* on three sides are outside of the periphery of the information storage medium 16, so that the information storage medium 16 is not joined to the top 12 and bottom 14 sheets along at least three sides.

Figure 3:
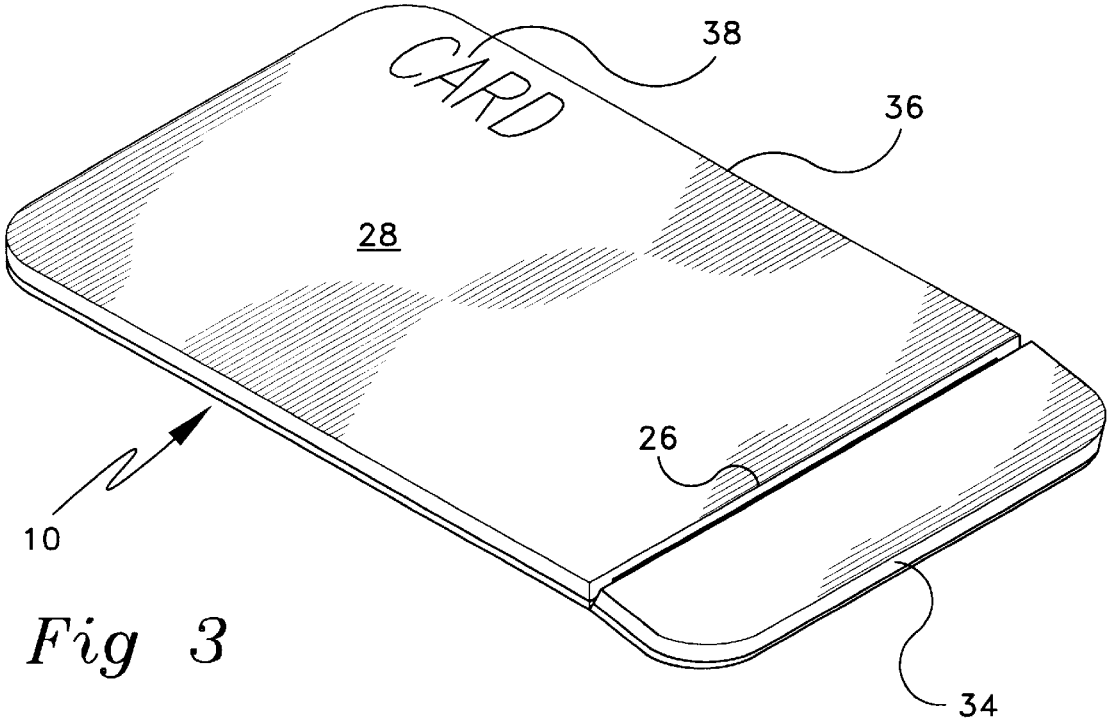
FIG. 3 is a perspective view of a frangible card with a sealed compartment according to the present invention with the frangible end bent and partially torn along the score line.
Figure 4:
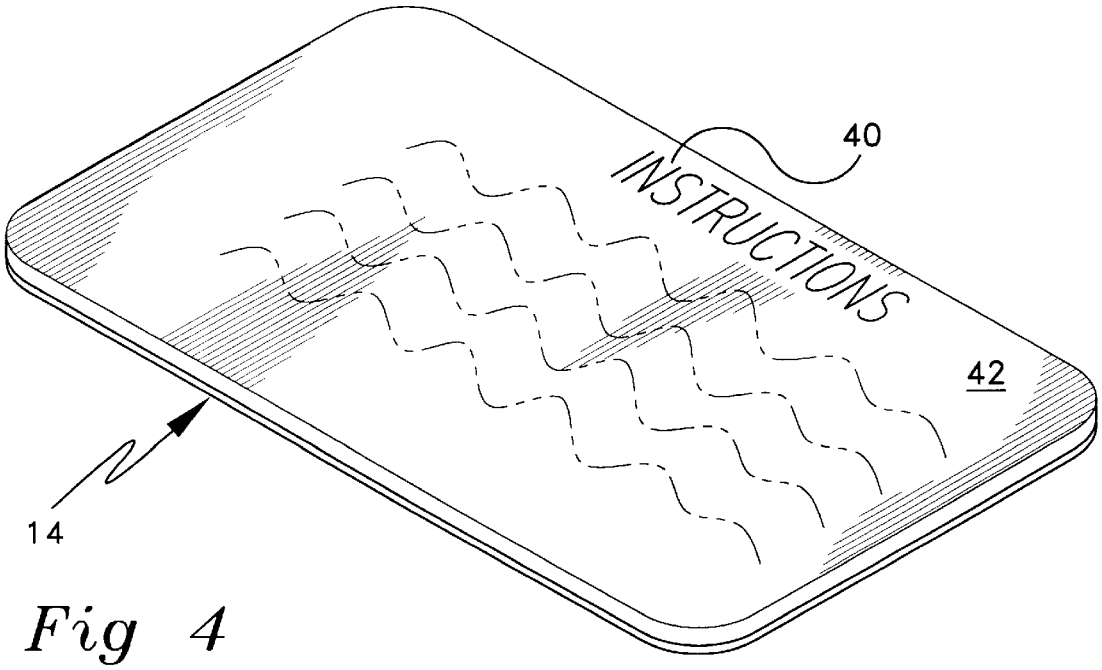
FIG. 4 is a bottom perspective view of a frangible card with a sealed compartment according to the present invention.

The top sheet 12 includes a line 26 scored on its exterior surface 28 transversely across one edge of the card 10. The bottom sheet 14 also includes a line 30 scored on its interior surface 32 transversely across the same edge of the card 10 in registration with the score line 26 on the top sheet 12. The score line 30 on the bottom sheet is neither visible nor palpable from the exterior of the card 10, as reflected in FIG. 4. As shown in FIG. 3, when it is desired to access the information storage medium 16, the card is bent and torn along the score line 26, leaving a tab 34 which breaks away from the main body 36 of the card 10 to open the sealed compartment 20. In the preferred embodiment, the information storage medium 16 is joined to the top 12 and bottom 14 sheets at the tab 34, so that the information storage medium is withdrawn from the sealed compartment 20 as the tab 34 is pulled away from the main body 36 of the card 10, as shown in FIG. 1. The information storage medium 16 may be perforated transversely adjacent the tab 34 so that the tab may be torn off and discarded. Of course, once the tab 34 has been broken from the main body 36, the card 10 cannot be reassembled, so that it will be obvious that the card 10 has been tampered with or accessed. As also shown in FIG. 1, paper money A or other flat, sheet type valuables or documents may be folded and stored loosely in the sealed compartment 20 with the information storage medium 16.

The top sheet 12 and the bottom sheet 14 are opaque in order to preserve the contents of the sealed compartment 20 with a relative degree of privacy. The exterior surface 28 of the top sheet may have indicia 38 imprinted thereon. The printed indicia 38 may disclose that the frangible card 10 is an emergency card, or it may bear no relation to the information storage function of the card 10. The scored line 26 may or may not be visible or palpable, depending on the details of manufacture. The exterior surface 42 of the bottom sheet 14 may also have indicia 40 imprinted thereon. The indicia 40 may include instructions to advise police or emergency personnel of the nature of the information contained in the sealed compartment 20 and how to access the information, or the indicia 40 may bear no relation to the information storage function of the card 10.

It will be apparent to those skilled in the art that although the means for accessing the contents of the sealed compartment has been described as a scored line 26, 30, that other means of weakening the card 10 along an edge thereof in order to access the contents of the compartment 20 may be employed, the essence of the invention consisting of an opaque plastic card having a sealed compartment therein for the storage of information, documents, and valuables, which may and must be broken in order to access the contents of the compartment.

It is to be understood that the present invention is not limited to the embodiments described above, but encompasses any and all embodiments within the scope of the following claims.

We claim:

1. A frangible card with a sealed compartment comprising a top sheet and a bottom sheet, the sheets being substantially rigid and made from a synthetic, polymeric, plastic material, the sheets further being generally rectangular in shape and joined to each other around the periphery on all four sides in order to define a sealed compartment, the sealed compartment being dimensioned and configured for containing flat articles, said card having frangible means for providing access to the sealed compartment; and wherein said top sheet has an exterior surface and said bottom sheet has an interior surface, said frangible means comprising a first line scored in the exterior surface of said top sheet, and a second line scored in the interior surface of said bottom sheet, the score lines being registered and extending transversely across an end of the card to define a tab and a main body, whereby upon breaking said tab along said score lines access to said sealed compartment is obtained.

2. The frangible card according to claim 1, wherein said top sheet is joined to said bottom sheet by vibratory welding.

3. The frangible card according to claim 1, wherein said top sheet is joined to said bottom sheet by ultrasonic welding.

4. The frangible card according to claim 1, wherein said top sheet is adhesively joined to said bottom sheet.

5. The frangible card according to claim 1, wherein said top sheet is joined to said bottom sheet by nylon stitching.

6. The frangible card according to claim 1, wherein said top sheet is joined to said bottom sheet by stapling.

7. The frangible card according to claim 1, wherein said frangible card is sized and shaped in the form of a conventional credit card, whereby said card is capable of transport on or about a person.

8. The frangible card according to claim 1, further comprising an information storage medium stored in said sealed compartment.

9. The frangible card according to claim 8, wherein said information storage medium comprises paper.

10. The frangible card according to claim 8, wherein said information storage medium comprises cardboard.

11. The frangible card according to claim 8, wherein said information storage medium comprises film.

12. The frangible card according to claim 8, wherein said information storage medium comprises magnetic tape.

13. The frangible card according to claim 8, wherein said information storage medium is bonded to said tab, so that said information storage medium is removable from said sealed compartment by breaking said tab from said main body and pulling said tab away from said main body.

14. The frangible card according to claim 8, wherein said information storage medium comprises a flat material capable of exhibiting data in written or printed form.

15. The frangible card according to claim 8, wherein said frangible card is sized and dimensioned for transport on or about a person.

* * * * *